US008100140B1

(12) United States Patent
Cantolino

(10) Patent No.: US 8,100,140 B1
(45) Date of Patent: Jan. 24, 2012

(54) STRENGTH-ENHANCED WATER-COLLECTING PAN FOR USE UNDER STORAGE HOT WATER HEATERS

(76) Inventor: Christopher Ralph Cantolino, Bradenton, FL (US)

( * ) Notice: Subject to any disclaimer, the term of this patent is extended or adjusted under 35 U.S.C. 154(b) by 317 days.

(21) Appl. No.: 12/563,669

(22) Filed: Sep. 21, 2009

(51) Int. Cl.
*B65D 1/34* (2006.01)

(52) U.S. Cl. ..... 137/312; 220/571

(58) Field of Classification Search ..... 137/312; 220/571
See application file for complete search history.

(56) References Cited

U.S. PATENT DOCUMENTS

| | | | | |
|---|---|---|---|---|
| 3,069,671 | A | 12/1962 | Taylor | |
| 3,519,233 | A | 7/1970 | Logsdon | |
| 4,765,360 | A | 8/1988 | Baird | |
| 5,368,263 | A | 11/1994 | Harrison | |
| 5,645,103 | A | 7/1997 | Whittaker | |
| D429,802 | S | 8/2000 | Whyte | |
| 6,116,266 | A * | 9/2000 | Dickison et al. | 137/312 |
| D434,125 | S | 11/2000 | Remeyer | |
| 6,719,164 | B2 * | 4/2004 | Maschio | 220/571 |
| 6,997,207 | B2 * | 2/2006 | McKesson | 137/312 |
| D582,023 | S | 12/2008 | Sheppard | |
| 7,637,387 | B1 * | 12/2009 | Cantolino | 220/571 |
| 7,673,646 | B1 * | 3/2010 | Cantolino | 137/312 |
| 7,900,795 | B1 * | 3/2011 | Cantolino | 220/571 |

* cited by examiner

*Primary Examiner* — Kevin Lee
(74) *Attorney, Agent, or Firm* — Dorothy S. Morse

(57) ABSTRACT

A multi-level fluid-collecting pan configured for placement under an upright cylindrical hot water heater tank and support thereof. It has a circular bottom surface integral with a raised central hub, multiple raised arcuate spokes extending outwardly from the hub, and multiple elevated risers extending from the perimeter wall toward the hub. A perimeter wall around the bottom surface defines a non-raised fluid-collecting area. Vibration isolators that support a hot water heater tank upon the risers maintain the tank above any accumulated water in the non-raised areas of the bottom surface. Low elevation risers in perpendicular orientation to some risers, a nesting configuration with mismatched indents, sturdy and impact-resistant materials, a drain opening in the perimeter wall, and an upturned lip extending upwardly from the perimeter wall, are also preferred. The hub, spokes, and risers cover much of the pan's bottom surface and force accumulated water toward the perimeter wall.

20 Claims, 8 Drawing Sheets

STRENGTH-ENHANCED WATER-COLLECTING PAN FOR USE UNDER STORAGE HOT WATER HEATERS

CROSS-REFERENCES TO RELATED APPLICATIONS

None.

BACKGROUND

Field of the Invention

This invention relates to stands for hot water heater tanks that are maintained in an upright orientation to store heated water in a ready-to-use condition, specifically to a water-collecting pan configured for placement under an upright storage hot water heater tank wherein an integrated multi-level bottom structure in the pan includes a centrally located star pattern comprising a center hub and multiple arcuate spokes radiating therefrom. The integrated pan structure also includes a plurality of risers each having substantially even height dimension to that of the hub and spokes, and positioning between adjacent spokes without contact with the hub or spokes. Risers depend from the perimeter wall surrounding the hub and spokes, and extend inwardly toward the hub, and if they have an arcuate perimeter configuration that creates a shorter side, it is preferred for the shorter sides of arcuate risers and arcuate spokes to face one another. The perimeter wall of the present invention pan also preferably has an upturned lip that extends above the top surfaces of the hub, spokes, and risers, and the integrated multi-level bottom structure also preferably includes a strength-enhancing low elevation riser attached in perpendicular orientation to some of the risers. Thus, the central star pattern enhances pan strength, as does the combination of straight and curved lines that are a part of the multi-level integrated structure which, by increasing pan rigidity, decreases the risk of cracks during handling, transport, and use, that could otherwise lead to a breach in pan integrity. Non-raised water-collecting areas on the bottom surface of the pan are located between the perimeter wall and the hub, as well as around the spokes and risers, and they communicate with one another so that water accumulated to a certain depth will begin to drain from the pan through an opening in a flattened area of the perimeter wall that is configured to facilitate drain line connection. Water accumulation in isolated areas of the pan is discouraged by the integrated structures disclosed herein. Also, the maximum water-holding capacity of a present invention pan is significantly less that that of the hot water heater tank it supports. Thus, present invention pans are primarily used to reduce the risk of damage to the tank itself, as well as to its surroundings, from water accumulation resulting as a result of slow leaks in the tank and/or its water connection fittings, as well as to prevent water that is expected to remain under a hot water heater tank after needed flushing and/or other maintenance activity, from causing corrosion or mold on the exterior bottom surface of the hot water heater tank. Additionally, needed maintenance for hot water heaters is sometimes deferred by those concerned about a risk of accelerated tank failure due to corrosion from residual water remaining around a hot water heater after a flushing or other maintenance procedure occurs. However, this concern is overcome by present invention use, as a hot water heater tank supported upon a present invention pan is allowed to dry out after its external surfaces have contact with water, so that corrosion is avoided, or at least minimized). Therefore, use of a present invention helps to prolong the life of the hot water heater tanks it supports by encouraging maintenance to occur on schedule. One should note that it is never intended for the present invention pan to have sufficient water-holding capacity to accommodate the entire water volume present in a supported hot water heater tank at once, should catastrophic failure of the tank occur. Motivation behind the configuration and compact size contemplated for the present invention pan includes, but is not limited to, the small area generally reserved for most hot water heater installations, the space required by local code between side of a hot water heater tank and adjacent structure, ease of manufacture, ease of handling before and during installation, and reduction in material cost. The integrated structure shown in the accompanying illustrations increases pan strength sufficiently so that the thickness dimension of the material used to manufacture the present invention pan can be reduced, saving material cost, yet allow the pan to remain able to stably support a heavy hot water heater tank over a period of many years.

In addition to the other structure identified hereinabove, it is also preferred for each riser in a present invention pan to have a top indentation configured to receive a vibration isolator, which facilitates successful movement of a heavy hot water heater tank over the top surfaces of hub, spokes, and risers during pan/tank installation without pan damage, and also helps the supported hot water heater tank to remain in its originally installed position during long-term use. It is also preferred for the present invention pan to be manufactured from a single sheet of plastic, and for it to have a nesting structure that allows adjacent pans to be compactly transported and stored. Additionally, several small indents or other structure (such as but not limited to small protrusions) of slightly differing dimension and/or configuration from one another, may be incorporated into the upturned lip above the perimeter wall, to reduce the likelihood of adjacent pans sticking together during transport and storage. Thus, prior to being placed into a stack of pans, each successive pan can then be rotated relative to the one above it, as well as relative to the one below it, with pairs of mismatched indents becoming aligned. Also, when a storage hot water heater tank is in its position of use supported on multiple vibration isolators each secured to the top surface of a riser in a present invention pan, a small gap will be present between the exterior bottom surface of the storage hot water heater tank and the top surfaces of the hub, spokes, and risers that allows the elevated tank to dry out after exposure to water, and reduce the risk of deterioration due to the presence of corrosion and/or mold. The risk of corrosion is also reduced since the hub, spokes and risers are all configured to disperse water downwardly into the non-raised bottom water collecting surface areas of the pan, and away from the supported hot water heater tank. Thus, use of a present invention pan decreases the incidence of corrosion and mold on a supported storage hot water heater tank, helping to reduce maintenance issues for the storage hot water heater tank and prolong its useful life, while also providing handling ease and other benefits for installers.

BACKGROUND

Description of the Related Art

When tank-type storage water heaters are employed in homes and commercial buildings, long-term use is anticipated over many years. They heat water at a relatively slow rate, and then store it for later use, so that a supply of hot water is available at all times. As long as they perform as expected, they are typically left alone without frequent inspection. In the United States storage water heater tanks are usually cylindrical and have a vertical orientation. Furthermore, the capacity of tank-type storage water heaters employed in the United States for household use often ranges between 20 gallons and 100 gallons, with larger tanks providing less temperature fluctuation. Unsurprisingly, as the age of a hot water heater increases, the risk of tank and water connection fitting leakage also increases. Should a leak not be readily found, damage to surroundings is a risk, even if the tank is placed in a basement, garage, or laundry room facility apart from the main living space in a residence. Also, water remaining around a hot water heater tank after needed flushing and/or other maintenance activity occurs, which is not allowed to evaporate or move away from the hot water heater tank, places it at risk for corrosion and mold that in some environments would quickly appear on its exterior surface.

Prior art hot water heater stands or trays with water-collecting capability are known. However, they are different in structure from the present invention. U.S. Pat. No. 3,069,671 to Taylor (1962) shows an alarm-equipped drain pan having a drain hole positioned through its bottom surface in a position not immediately under the area where the hot water heater would be located, and a conduit connected to the drain hole under the surface upon which the pan is supported. The pan appears void of elevated support structure upon which an upright hot water heater tank could be supported. U.S. Pat. No. 3,519,233 to Logsdon (1968) also shows a hot water heater stand and drain pan, with the pan having a center drain hole. It too appears void of elevated support structure upon which an upright hot water heater tank could be supported. U.S. Pat. No. 4,765,360 to Baird (1988) shows a water heater leak collector having a collector base, a thin strip wall around the base, and a collector base orifice that is connected to suitable draining means. No elevated support structure in the collector base is revealed as a part of the Baird disclosure. U.S. Pat. No. 5,368,263 to Harrison (1994) shows a height adjustable water heater stand that includes a drainage system. However, no elevated support structure upwardly depending from the central portion of the Harrison stand is revealed. Furthermore, the water heater stand in U.S. Pat. No. D434,125 to Remeyer (2000) resembles the Harrison stand, except that the perimeter configuration of the Remeyer stand has the shape of an octagon, and the hot water heater stand in U.S. Pat. No. D58,223 to Sheppard (2008) resembles the Baird stand, with none having raised central support structure for a supported upright hot water heater tank. The water heater stand with overflow catch basin in U.S. Pat. No. 5,645,103 to Whittaker (1997) is a little closer in concept to the present invention pan, as it has elevated support members with channels in between adjacent supports. However, there are also many differences, such as the supports being adjacent to the wall (and none centrally located), a center drain opening (instead of a central raised hub to which spokes are attached), no elevated supports outwardly directed from the perimeter wall (as the risers in the present invention), no low elevation risers in perpendicular orientation to any elevated support (as in the present invention), and no drain opening through the perimeter wall.

The invention thought to be the closest in structure to the present invention is the water heater riser disclosed in U.S. Pat. No. D429,802 to Whyte (2000). It is formed from a single sheet of plastic to create a central cavity surrounded by four edge cavities. In contrast, the present invention pan has a raised central hub and multiple arcuate spokes extending therefrom toward its perimeter wall. Also, between its spokes, the present invention pan has risers, some of which have a lower elevation riser connected in perpendicular orientation thereto. In addition, the present invention risers each preferably have a top indentation configured for receiving a vibration isolator, and are configured to reduce the risk of stress cracks developing in a present invention pan when a heavy storage hot water heater tank is moved across its top surface during installation. Furthermore, the design of the hub, spokes, and risers are created to reduce thin or weak spots in the pan material as the multi-level structure of the present invention pan is formed that could lead to crack development and premature deterioration and/or failure during extended use, with the design of the hub, spokes, and risers also having a goal of providing sturdy construction that facilitates installation, shortens installation time, provides stable installation, provides trouble-free long-term use, and minimizes maintenance after installation. No other fluid-collection pan is known with the same structure, which functions in the same manner, or provides all of the advantages of the present invention.

BRIEF SUMMARY OF THE INVENTION

It is the primary object of this invention to provide a water-collecting pan of sturdy construction for use in long duration and stable support of an upright storage hot water heater tank having a substantially cylindrical construction, which holds the tank above water that can accumulate as a result of slow leaks and maintenance activity, and allows such water to evaporate and/or drain away from the tank so that the tank can dry out and avoid corrosion and mold that would otherwise shorten its useful life. It is a further object of this invention to provide a water-collecting pan for support of an upright storage hot water heater tank wherein the pan has an integrated structure that allows it to effectively fulfill its intended fluid collection function while resisting permanent deformation, cracking, and/or material weakening as a result handling anticipated during installation, pre-installation transport, and storage. It is also an object of this invention to provide a water-collecting pan for support of an upright storage hot water heater tank that facilitated manufacture and enables stable installation, facilitates installation, shortens installation time, facilitates drain line connection, and requires minimal post-installation inspection and maintenance. A further object of this invention is to provide a water-collecting pan for support of an upright storage hot water heater tank wherein the pan has a nesting structure for compact transport and storage, and provisions to prevent pans from sticking together in stacked array. In addition, it is a further object of the present invention to provide a water-collecting pan for support of an upright storage hot water heater tank wherein the pan is made from crack resistant, corrosion resistant, fire resistant, extremely durable materials that resist premature deterioration and malfunction, as well as have resistance to temperature extremes.

The present invention, when properly made and used, will provide a water-collecting pan of sturdy construction and resilient materials that can be used for reliable long-term support of a storage hot water heater tank in an elevated position above fluids accumulating below it as a result of slow leaks or maintenance activity, and which further directs water away from the hot water heater tank to allow it to dry out and reduce premature deterioration of its exterior surface. Reduced risk of damage to surroundings is also a benefit of present invention pan use. However, due in part to the space limitations typically encountered at hot water heater tank installation sites, it is not contemplated for the water-holding capacity of the present invention pan to be big enough to hold the entire water volume present in a supported hot water heater tank at once, should catastrophic failure of the tank occur. A central hub and arcuate spokes connected thereto, which are integral to the present invention pan's bottom surface, substantially fill the pan's center portion to more rapidly direct fluid accumulating in the non-raised areas between spokes toward switch/drain connections on the surrounding perimeter wall. The hub connection is desired to prevent the spokes from twisting and allows the manufacture of larger present invention pans for use under larger capacity storage tanks. Spokes also have a convex top surface and outwardly-and-downwardly sloping sides/walls that prevent fluid accumulation thereon, as well as improve fluid flow around them to facilitate communication between the various water collection areas in the pan and avoid excess water collection in any one portion of the pan's bottom surface. The arcuate perimeter configuration of the spokes also avoids the formation of pressure points during the pan's manufacture, which could otherwise develop into cracks in the pan material during pre-installation handling or use. The sloping and arcuate surfaces in the spokes further allow as much material as is needed to be pulled from a single sheet of plastic, without causing weak points. In fact, none of the vertically-extending surfaces of the present invention pan has a precisely vertical orientation, including the sides of the central hub, spokes, and both types of risers (which are all downwardly-and-outwardly sloping), and the perimeter wall and its upturned lip (which are each upwardly-and-outwardly inclined).

Two types of risers in the present invention pan further strengthen it, with each type of riser having a different height dimension from the other that pulls just enough material during manufacture to prevent pressure points between them that might otherwise lead to the development of cracks in the pan material during its handling and extended use in supporting a heavy hot water heater tank. Reinforcement structure is also provided between each riser and the perimeter wall for the same purposes. Furthermore, the perpendicular orientation of the smaller low elevation risers to the taller risers allows an installer to slide a hot water heater across The substantially circular perimeter wall of the present invention pan also has an upturned lip that provides additional fluid-collection depth that extends upwardly above the top surfaces of the hub, spokes, and risers. It is further contemplated in the most preferred embodiments of the present invention for the central hub, spokes, and risers to each have a nesting configuration for compact storage and transport of pans in stacked array. Small indents of varying mismatched configuration can also be used in the upturned lip to prevent adjacent pans from sticking together during their storage and transport. Thus, each successive pan placed into a stack of pans can then be rotated relative to the one above it, as well as relative to the one below it, to facilitate removal of one or more pans from a stack, when needed. Furthermore, although the present invention is primarily contemplated for use in hot water heater applications to avoid damage and accelerated tank deterioration from slow leaks, it also may be used in other applications where rising fluid beyond a threshold limit is undesirable and prompt notification thereof is needed to eliminate the risk of property damage. Many switches are known that respond to a very small amount of water accumulation, and can be associated with the present invention pan for such purposes. Since the fluid collecting pan of the present invention is made from corrosion-resistant plastic materials, premature deterioration and malfunction thereof due to corrosion are avoided.

The present invention pan materials are also fire resistant and resistant to failure as a result of exposure to temperature extremes, so that installation in unheated basements, garages, and/or laundry rooms detached from main residence areas is possible. The perimeter wall of the present invention pan is also sufficiently sturdy and may be configured for effective use with fluid-level detection devices and alarms. Thus, since a storage hot water heater tank is supported on vibration isolators secured to the top surfaces of the risers in a present invention pan, air circulation space exists directly under its exterior bottom surface, which after exposure to water is then allowed to dry out, reducing the risk of corrosion and mold, and helping to reduce maintenance issues so as to prolong its useful life.

The description herein provides preferred embodiments of the present invention but should not be construed as limiting its scope. For example, variations in the thickness dimension of the sheet material used to form a present invention pan; the length, width and height dimensions of the spokes connected to the hub as long as they remain lower than the top of the perimeter wall and allow sufficient non-raised water collection areas to remain in the pan's bottom surface; the placement of the drain opening as long as it does not displace the positioning of a needed riser; the amount and type of curvature in the arcuate perimeter configuration of the spokes; the height dimension of the central hub, spokes and risers in the same present invention embodiment, as long as all are substantially the same; the length and width dimensions of the flattened area in the perimeter wall surrounding the drain opening; the height dimension of the perimeter wall and its upturned lip, and the number and configuration of small indents used in the upturned lip to avoid the sticking together of stacked pans, other than those shown and described herein, may be incorporated into the present invention. Thus, the scope of the present invention should be determined by the appended claims and their legal equivalents, rather than being limited to the examples given.

COMPONENT LIST

2—most preferred embodiment of the present invention pan

2'—alternate embodiment of the present invention pan having straight risers 8, a small hub 20, very long spokes, and indentations 14 in risers 8 that are on the proximal end of a riser, instead of on its distal end, as in pan 2

4—perimeter wall of pan 2

Figure 6:
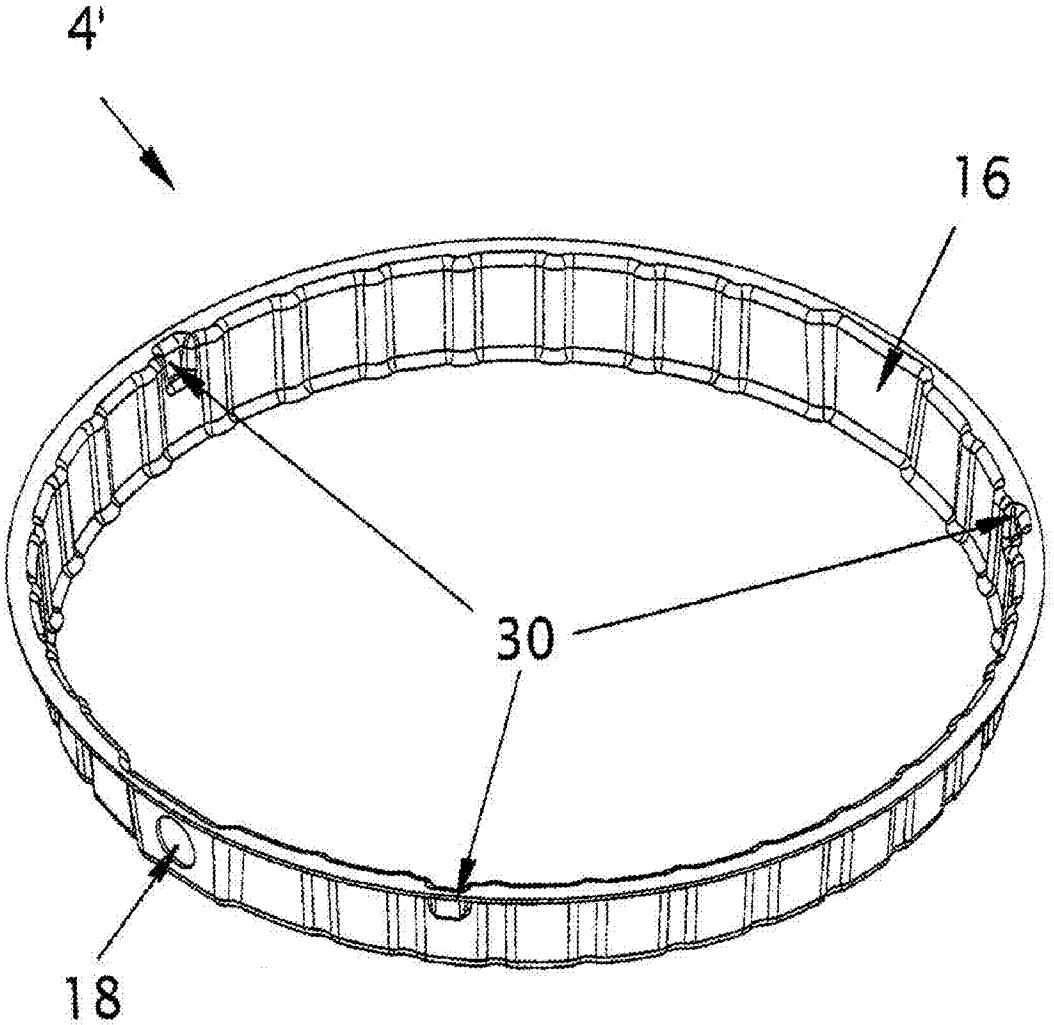
FIG. 6 is a perspective view of an alternate pan wall configuration that can be used in the most preferred embodiment of the present invention with small indents of mismatched configuration to one another that can be used to prevent adjacent pans from sticking together when pans are rotated relative to the next adjacent pans while stacked for storage or transport so that mismatched indents in adjacent pans become aligned.

4'—alternate perimeter wall having upper edge indents 30 (see FIG. 6)

6—upturned lip extending above perimeter wall 4

8—riser extending from perimeter wall 4 and having its distal end between two adjacent spokes

10 (riser 8 can have a straight or arcuate configuration)

10—arcuate spoke extending from central hub 20 toward perimeter wall 4 (it is preferred for all spokes 10 to curve in the same direction)

12—non-arcuate low elevation riser attached in perpendicular orientation to some risers 8

14—indentation in the top surface of risers 8 for securely receiving a vibration isolator 34 (see FIG. 8) used to assist in the movement of a heavy hot water heater across pan 2 or 2' without any damage or weakening in the pan's structure (more than one indentation can be present in any or all risers 8)

16—a flattened area in perimeter wall 4 or 4' that is generally complementary in configuration to drain opening and flattened area 18, and is positioned opposite from drain opening and flattened area 18 on perimeter wall 4 or 4' to allow for compact nesting of adjacently stacked pans pan 2 or 2'

18—drain opening and the flattened area around it in perimeter wall 4 or 4' that allows the secure connection of conduit (not shown) configured to direct surplus collected water away from pan 2 or 2' when collected water reaches a depth that allows entry into the conduit

20—central hub from which multiple arcuate spokes 10 extend toward perimeter wall 4 or 4' and which prevents the twisting of spokes 10

22—hollow area under central hub 20, risers (8 and 12), and spokes 10, that permits nesting of stacked pans 2 or 2' for compact storage and transport thereof

24—non-raised water collecting area in bottom of pan 2 or 2' that is positioned around hub 20, and also positioned between risers (8 or 12) and spokes 10

26—reinforcement structure provided between risers 8 and perimeter wall 4

28—downwardly and outwardly angled sides/walls of raised central hub 20

30—small mismatched indents used in the upper edge of pan wall 4' that can be used to prevent adjacently stacked pans 2 or 2' from sticking together

32—hot water heater

34—vibration isolator that can be used in indentations 14

DETAILED DESCRIPTION OF PREFERRED EMBODIMENTS

Figure 7:
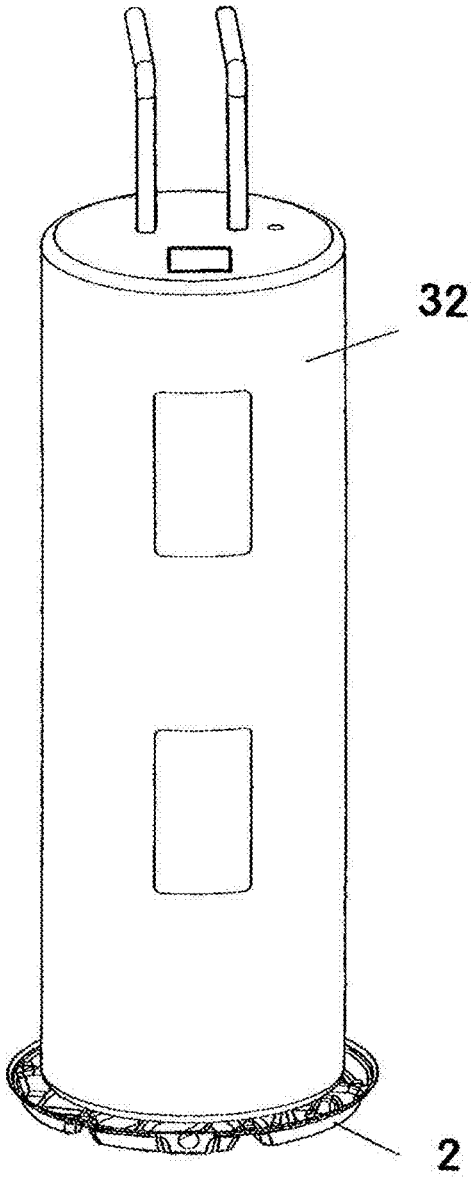
FIG. 7 is a side view of an upright cylindrical storage hot water heater tank being supported upon a present invention water-collecting pan.

The present invention is a sturdy fluid-collecting pan (2, 2' or other) primarily for placement under a cylindrical storage hot water heater tank 32 (such as that shown in FIG. 7) in an upright orientation, and support thereof in a stable and fixed position during its use, wherein the present invention pan has a multi-level construction with a non-raised bottom water-collection surface 24 having a substantially circular perimeter, a perimeter wall (4, 4' or other) surrounding bottom water-collection surface 24, with an upturned lip 6 upwardly-depending from perimeter wall (4, 4' or other), a drain opening 18 through one part of perimeter wall 4, a flattened area 16 of comparable size and configuration on perimeter wall 4 in a position opposed to drain opening 18 that improves the nesting capability of multiple pans 2 in stacked array, a raised hub 20 integral with the center portion of bottom water-collection surface 24, spaced-apart pan-strengthening and fluid-dispersing raised spokes 10 each having an arcuate configuration and extending from central hub 20 toward perimeter wall 4, with spokes 10 further having a convex top surface that diminishes fluid accumulation thereon, additional elevation integral to the non-raised bottom water-collection surface 24 in the form of risers 8 extending outwardly from perimeter wall 4 between adjacent spokes 6, with each riser 8 having an indentation 14 on its top surface configured for receiving a resilient vibration isolator (see FIG. 8 for an example of one that can be used with pan 2), and a small non-arcuate and low elevation riser 12 outwardly extending from alternate risers 8 and in perpendicular orientation thereto. The central hub 20, spokes 6, risers 8, and low elevation risers 12 cover much of the bottom of pan (2, 2' or other), leaving only non-raised water-collection surface 24 therebetween for movement of collected water toward drain opening 18. Pan (2, 2' or other) further comprises manufacture from sturdy and impact-resistant materials, which are also fire resistant and have thermal resistance to a wide range of temperature fluctuations. While FIGS. 1-4 show the most preferred embodiment of the present invention pan 2, FIGS. 5 and 6 show simple variations thereof, and FIG. 7 shows a pan 2 under an upright cylindrical storage hot water heater tank 32, FIGS. 8 and 9 respectively show the structure of a vibration isolator 34 that can be used as a part of the present invention in association with the indentations 14 on the top of risers 8 and preferred locations of vibration isolator 34 use. It is to be understood that many additional variations in the present invention are possible and also considered to be a part of the invention disclosed herein, even though such variations are not specifically mentioned or shown. As a result, a reader should determine the scope of the present invention by the appended claims.

Figure 1:
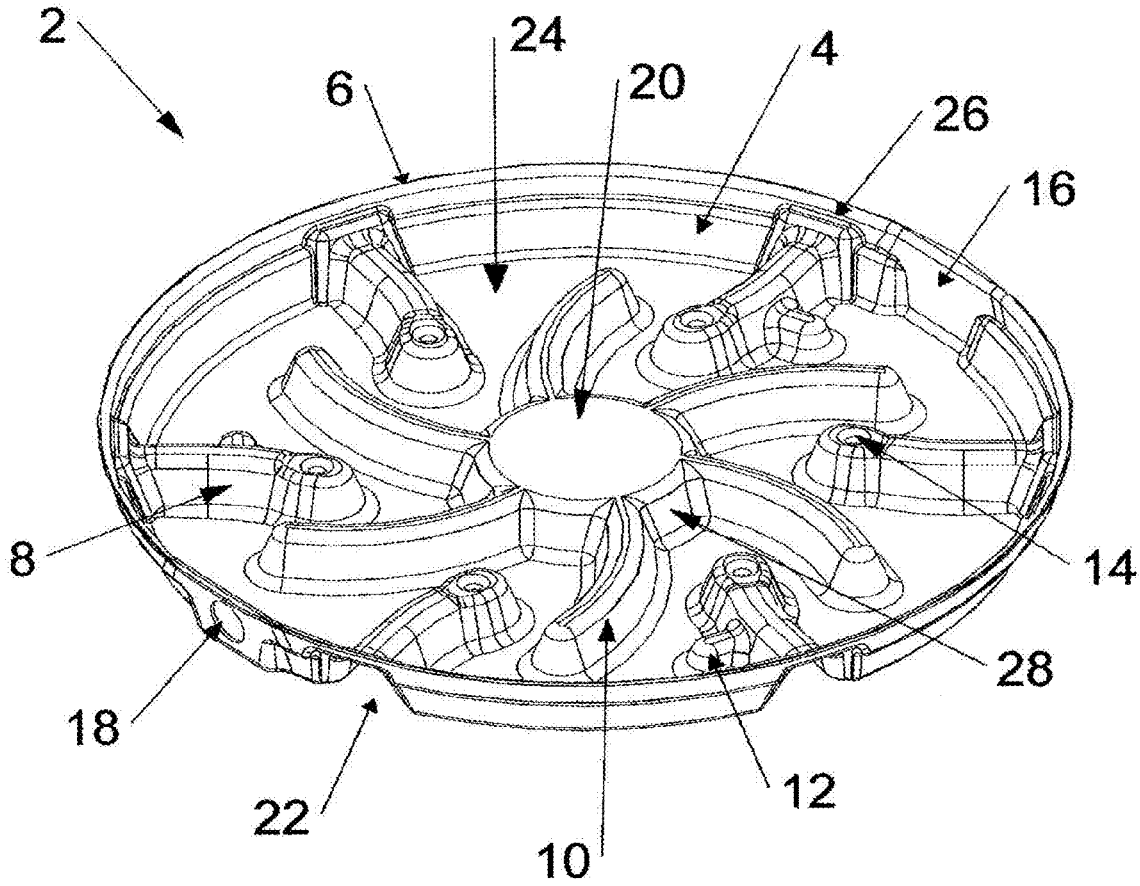
FIG. 1 is a perspective view of the most preferred embodiment of the present invention fluid-collecting pan having a circular perimeter wall with an upturned lip, at least one drain opening through the perimeter wall and a flattened area in the perimeter wall in a position opposed to the drain opening that promotes compact nesting of stacked pans, a raised central hub and raised spaced-apart spokes radiating outwardly therefrom so as to substantially fill the pan's center portion, a non-raised bottom surface providing water-collection areas between adjacent spokes configured to receive collected fluid and improve fluid flow to facilitate movement of fluid toward float switch and drain connections associated with the perimeter wall, with the spokes also each having a convex top surface and outwardly-and-downwardly sloping walls that prevent fluid accumulation thereon, and the arcuate perimeters of the spokes strengthening the pan and also avoiding the formation of pressure points in the pan's bottom surface which could otherwise cause cracks to develop in pan material during pre-installation handling and while in use, with the pan also having an arcuate riser between adjacent spokes and a low elevation riser positioned in perpendicular orientation to some of the arcuate risers, reinforcing structure shown between the proximal end of each riser and the perimeter wall, risers each having an indentation remote from the perimeter wall with a configuration adapted for securely receiving a vibration isolator therein, the hollow spaces under the risers and elsewhere that allow for compact nesting of present invention pans in stacked array, and further with all structural features raised from the pan's bottom surface being shorter in height dimension than that of the top of the upturned lip extending upwardly and outwardly from the pan's perimeter wall.
Figure 2:
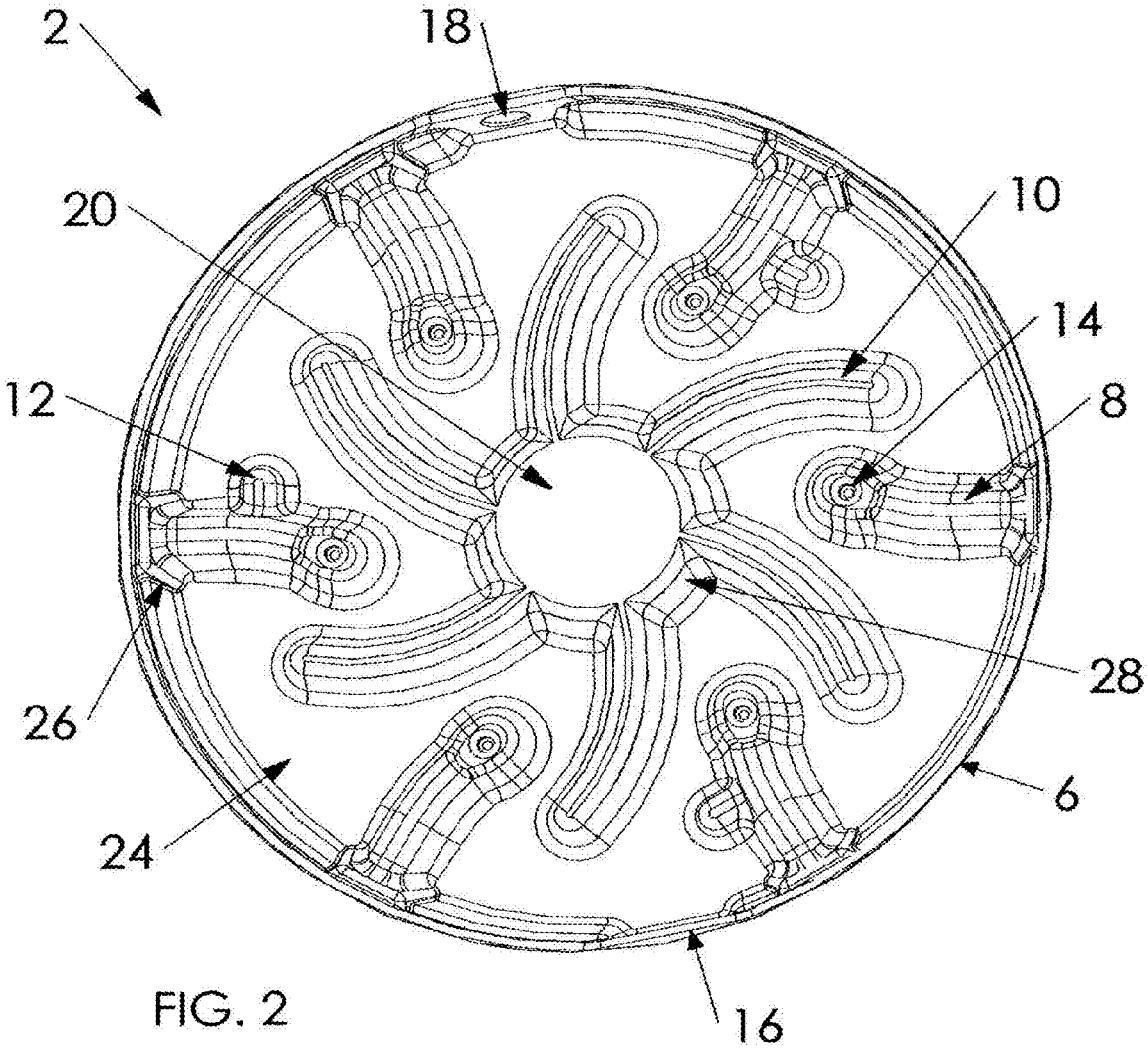
FIG. 2 is a top view of the most preferred embodiment of the present invention fluid collection pan.
Figure 3:
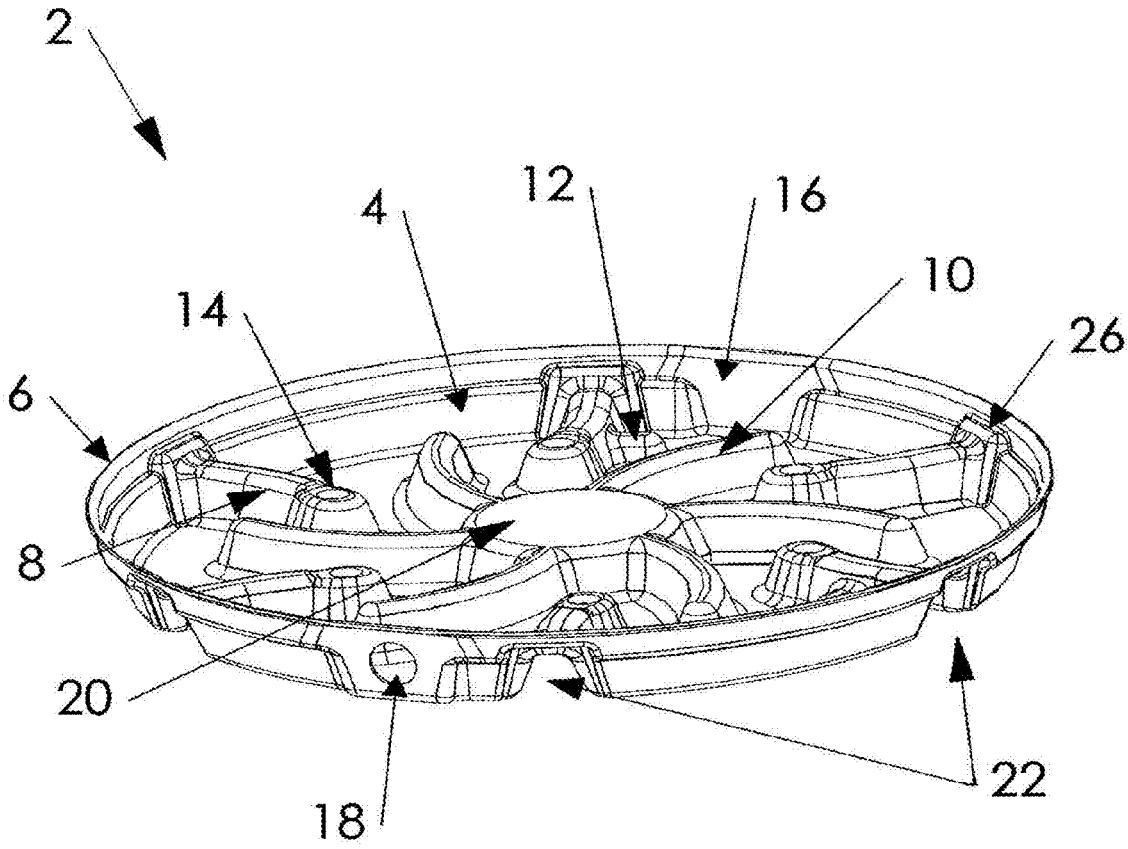
FIG. 3 is a side view of the most preferred embodiment of the present invention showing a drain opening positioned partially within the upturned lip.
Figure 4:
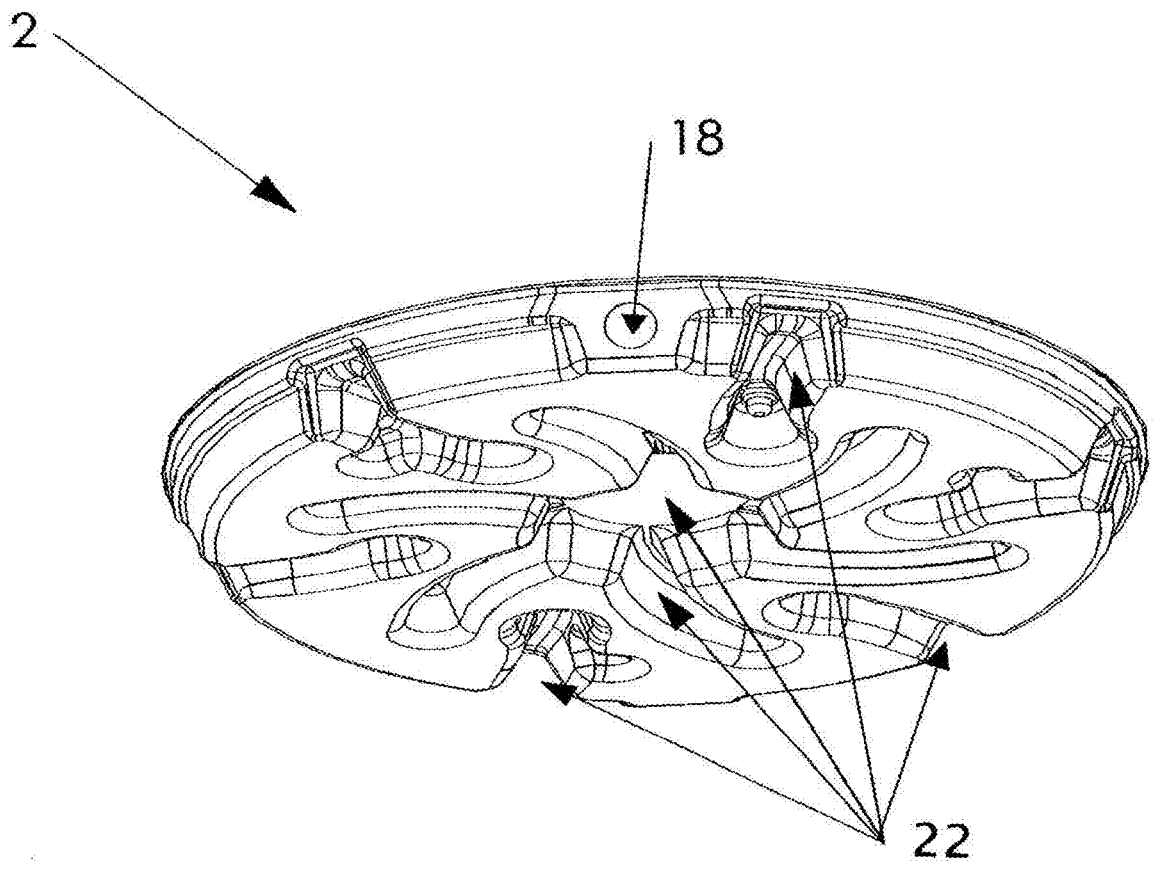
FIG. 4 is a bottom view of the most preferred embodiment of the present invention showing the hollow areas therein that are used to achieve compact nested storage.
Figure 5:
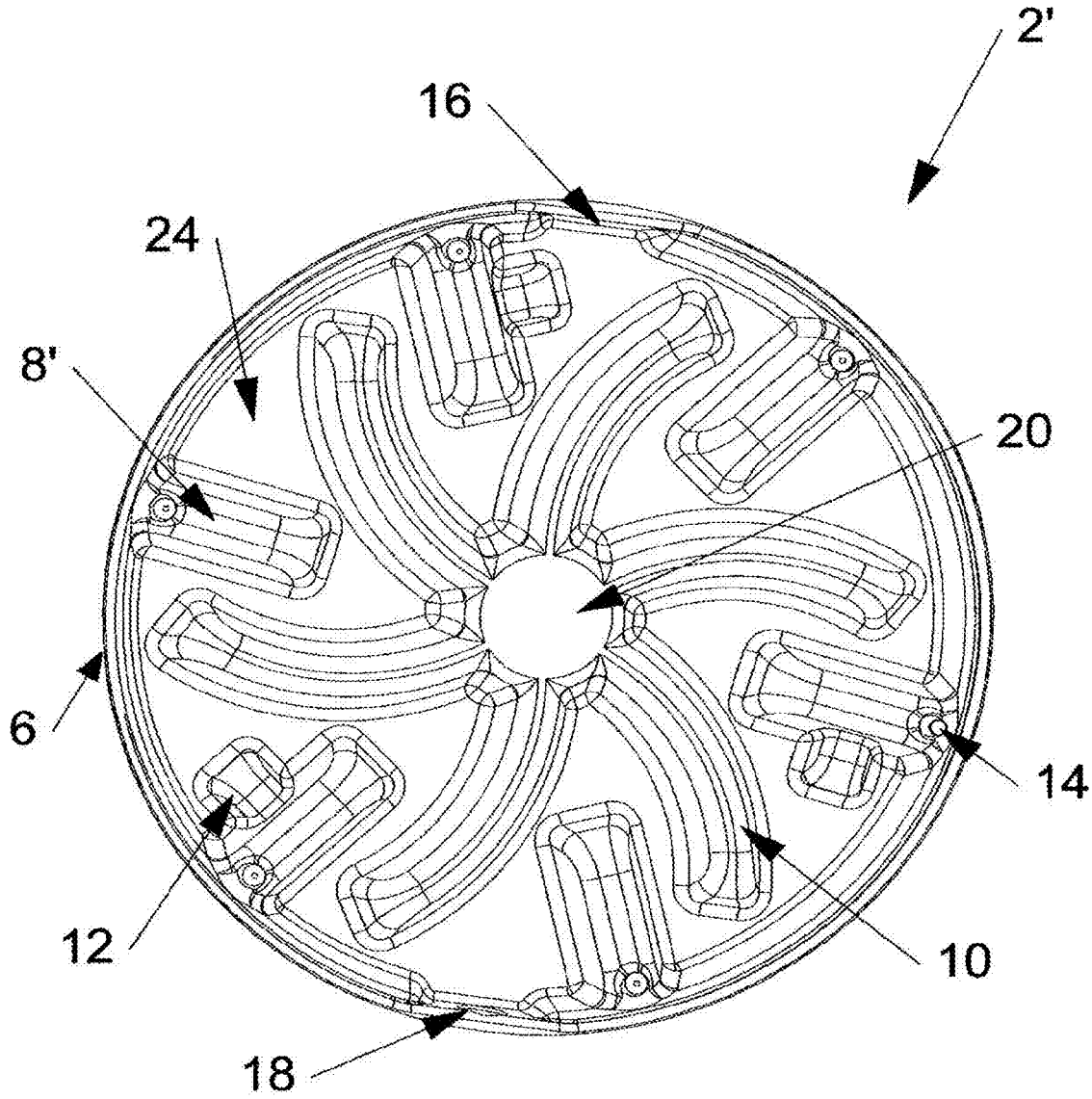
FIG. 5 is a top view of a second preferred embodiment of the present invention fluid collection pan having structure similar to that shown in FIGS. 1-4, with the exception of a smaller hub, longer arcuate spokes, the risers outwardly depending from the perimeter wall between adjacent spokes having a non-arcuate configuration, and risers each having an indentation at its proximal end, close to the perimeter wall instead of on its distal end, as shown in FIG. 1.

FIGS. 1-4 show a first and most preferred embodiment of the present invention pan 2. FIG. 1 is a perspective view of pan 2, while FIG. 2 is a top view of pan 2, FIG. 3 is a side view of pan 2 showing a drain opening near the upturned lip 6 of perimeter wall 4, and FIG. 4 is a bottom view of pan 2 showing the hollow areas 22 underneath pan 2 that are used for compact nested storage. As can be seen in FIG. 1, the most preferred embodiment of the present invention fluid collecting pan 2 has a circular perimeter wall 4 with an upturned lip 6 upwardly-depending from the top edge of perimeter wall 4. Although not clearly visible in FIG. 1, a strictly vertical configuration for perimeter wall 4 and upturned lip 6 is not preferred, and both are shown to have at least a slight upwardly-and-outwardly extending configuration that increases tooling east and pan strength, since as much pan material can be pilled to form it as is needed. As can also be seen in FIG. 1, pan 2 further comprises at least one drain opening 18 through perimeter wall 4, a flattened area 16 in perimeter wall 4 in an opposed position from drain opening 18 that assists in compact pan 2 nesting of multiple pans 2 in stacked array, a raised central hub 20, and raised, spaced-apart, and arcuate spokes 10 radiating outwardly in differing directions from huh 20 so as to substantially fill the center portion of pan 2. Central hub 20 and spokes 10 each have sides/walls with a downwardly-and-outwardly extending configuration so that fluid does not tend to accumulate upon their top surfaces. The present invention pan 2 structure further includes a non-raised bottom surface water-collection area 24 between adjacent spokes 10 which is configured to receive collected water from a leaking hot water heater tank 32, and/or its water connection fittings, and facilitate fluid flow toward float switch and drain line connections (if used) associated with perimeter wall 4, with the spokes 10 also each having a convex top surface, outwardly sloping walls, and arcuate perimeters that in combination strengthen pan 2 by reducing the formation of pressure points in and adjacent to the pan's bottom water-collection surface 24 during pan 2 manufacture, which could otherwise lead to cracks in pan 2 during pre-installation handling and while in use. In addition, FIG. 1 shows pan 2 having one riser 8 with an arcuate perimeter configuration positioned between each pair of adjacent spokes 10 and a low elevation riser 12 positioned in perpendicular orientation to some of the arcuate risers 8 on the side of arcuate risers 8 having a longer length dimension. The curved structure of risers 8 on combination with the straight structure of low elevation risers 12, provides strength in different directions and increases pan 2 rigidity to allow long-term support of a heavy hot water heater tank 32 (see FIG. 7), as well as sliding of a hot water heater tank 32 by an installer across pan 2 without causing damage to pan 2. The connection of central hub 20 to spokes 10 also reduces the twisting of spokes 10 that would otherwise occur without the presence of hub 20, while also improving the strength of pan 2. In fact, someone placing their hands on opposing sides of perimeter wall 4 and attempting to twist pan 2, cannot cause any movement, shift, oscillation, fluctuation or other motion in non-raised bottom surface water-collection area 24 or any of the structures (hub 20, spokes 10, or risers 8, 8', or 12) integral to it. In addition, FIG. 1 shows reinforcing structure 26 between the proximal end of each riser 8 and perimeter wall 4, risers 8 each having an indentation 14 on its distal end in a position remote from perimeter wall 4 and with a configuration adapted for securely receiving the lower part of a vibration isolator 34 (see FIG. 8 for an example of a vibration isolator that is usable with pan 2), and further with all structural features raised from the pan's bottom surface water-collecting areas 24 being smaller in height dimension than that of combined perimeter wall 4 and upturned lip 6. In FIG. 1, reinforcing structure 26 is shown extending across perimeter wall 4 and into upturned lip 6, which is preferred for greatest pan 2 strength. Also, risers 8 and low elevation risers 12 in FIG. 1 each having a convex top surface and downwardly-and-outwardly sloping walls, which in combination help to strengthen pan 2 and protect a supported hot water heater tank 32 in the same manner provided by similar configuration provided in spokes 10. FIG. 1 further shows all spokes 10 curved in the same direction with respect to central hub 20, with risers 8 having curvature that causes the shorted sides of spokes 10 and risers 8 to face one another, which is preferred as it provides strength in different directions and increases pan 2 rigidity to allow long-term support of a heavy hot water heater tank 32. Although the preferred length dimensions of spokes 10 and risers 8 are shown in. FIG. 1, such dimensions are not to be considered as critical to pan 2, including the length dimension of spokes 10 that are shown in FIG. 1 to be only slightly larger that the diameter dimension of hub 20. Also, as will be revealed later in the discussion of FIG. 5, the embodiment it illustrates has a smaller hub 20, spokes 10 having length dimensions that are approximately twice the diameter dimension of hub 20, positioning of indentations 14 in the top surface of risers 8' closer to perimeter wall 4, and the perimeter configuration of risers 8' having straight edges, instead of the curved sides shown in FIG. 1 for risers 8.

FIG. 2 shows the downwardly-and-outwardly sloping sides 28 of central hub 20 more clearly than FIG. 1. Also, FIG. 2 better shows the opposed positioning of drain opening 18 and flattened area 16 than can be observed in FIG. 1, in addition to the downwardly-and-outwardly sloping nature of the sides of both risers 8 and the low elevation risers 12 depending outwardly in perpendicular orientation from some risers 8. The arcuate configurations of all spokes 10 and all risers 8 are also very clearly revealed in FIG. 2, and the non-contact existing between risers 8 and spokes 10. In addition, FIG. 2 also shows the distal end location of indentations 14 on risers 8 that are each adapted for secure receipt of a vibration isolators (such as but not limited to that shown by the number 34 in FIG. 8). FIG. 2 also very clearly shows one example of the reinforcement structure 26 preferred between risers 8 and perimeter wall 4. In contrast, FIG. 3 shows spokes 10, risers 8, and central hub 20 all having approximately the same height dimension, reinforcing structure 26 taller than the height dimension of the riser 8 to which it is connected, and the visible low elevation risers 12 each being shown to have less than the full height dimension of risers 8 (perhaps about one-half or two thirds thereof; but such an example of preferred dimensions should not be considered as critical). In addition, FIG. 3 shows the drain opening 18 and opposed flattened area 16 in perimeter wall 4, and the hollow areas 22 underneath risers 8 that contribute to compact nested storage and transport of multiple present invention pans 2 in stacked array. Furthermore, the preferred upwardly-and-outwardly extending configuration of perimeter wall 4 and upturned lip 6 is clearly visible in FIG. 3. FIG. 4 further shows the hollow areas 22 needed beneath pan 2 to achieve compact nested storage of multiple pans 2 in stacked array as being under spokes 10 and central hub 20, as well as under risers 8 and low elevation risers 12. The number of risers 8 and spokes 10 used in pan 2 is not critical, nor is the diameter dimension of central hub 20, as long as there is sufficient bottom water-collection surface 24 in pan 2, and its strength is not compromised.

FIG. 5 is a top view of a second preferred embodiment of the present invention (marked as pan 2'), which shows a smaller hub 20, longer arcuate spokes 10, non-arcuate risers 8' outwardly depending from perimeter wall 4 between adjacent arcuate spokes 10, with non-arcuate risers 8' each further having an indentation 14 adjacent to its proximal end and closer to perimeter wall 4, instead of the positioning on its distal end, as shown in FIG. 1. FIG. 5 also shows spokes 10 not in contact with perimeter wall 4 of risers 8, spokes 10 having a length dimension approximately twice the diameter dimension of the hub, a smaller bottom water-collection surface 24 between spokes 10 and non-arcuate risers 8' (when compared to that shown in FIG. 1), and a low elevation riser 12 positioned in perpendicular orientation to every other non-arcuate riser 8' (similar to positioning shown in FIG. 1). The sides of the central hub 20, spokes 10, risers 8, and low elevation risers 12 visible in FIG. 5 are also shown to have a downwardly-and-outwardly sloping configuration, similar to that shown in FIG. 1. Furthermore, upturned lip 6, drain opening 18, flattened area 16, and indentations 14 for securely receiving a vibration isolator (such as that marked by the number 34 in FIG. 8) are also shown in FIG. 5, with structure that is similar to that in the most preferred embodiment of pan 2 shown in FIG. 1. FIG. 6 is a perspective view of an alternate perimeter wall 4' that can be used as a part of preferred embodiments of the present invention (and to which risers 8, 8', or other would be attached), with perimeter wall 4' having several small mismatched indents 30 of slightly different size and/or configuration that can be used to prevent adjacent pans (2, 2', or other) from sticking together when stacked for storage or transport. FIG. 6 also shows the desired opposed relation of drain opening 18 to the flattened area 16 in perimeter wall 4', the flattened area 16 having a mirror image configuration to that the flattened area surrounding drain opening 18, and indents 30 being offset from drain opening 18 and the flattened area 16. In addition, although not shown in the accompanying illustrations, the number, size, configuration, and placement of indents 30 is not limited to that shown in FIG. 6, as long as indents 30 or other similarly functioning structure (such as but not limited to small protrusions) do not interfere with the functions of drain opening 18, flattened area 16, and the reinforcement structure 26 used between risers 8 and perimeter wall 4, or diminish in any way the structural integrity of the present invention pan (2, 2', or other). Although not shown, to avoid sticking problems when present invention pans are stacked, instead of indents 30, asymmetrical bumps/protrusions can be used, with the pans (2, 2', or other), being partially rotated before stacking relative to the pans next adjacent thereto above and below it. However, testing by the inventor herein has shown that indents 30 on upturned lip 6 provide a preferred solution to the sticking problem occasionally experienced in present invention pans over the use of asymmetrical bumps.

Figure 8:
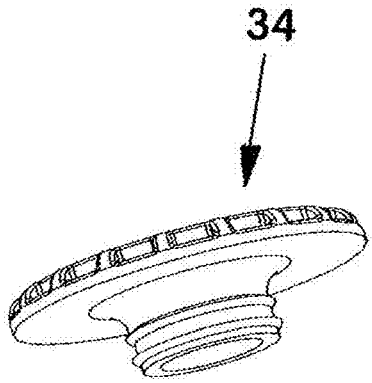
FIG. 8 is a bottom view of one type of vibration isolator that can be used as a part of the most preferred embodiment of the present invention and secured partially within one of the indentations 14 in the top surface of a riser 8.
Figure 9:
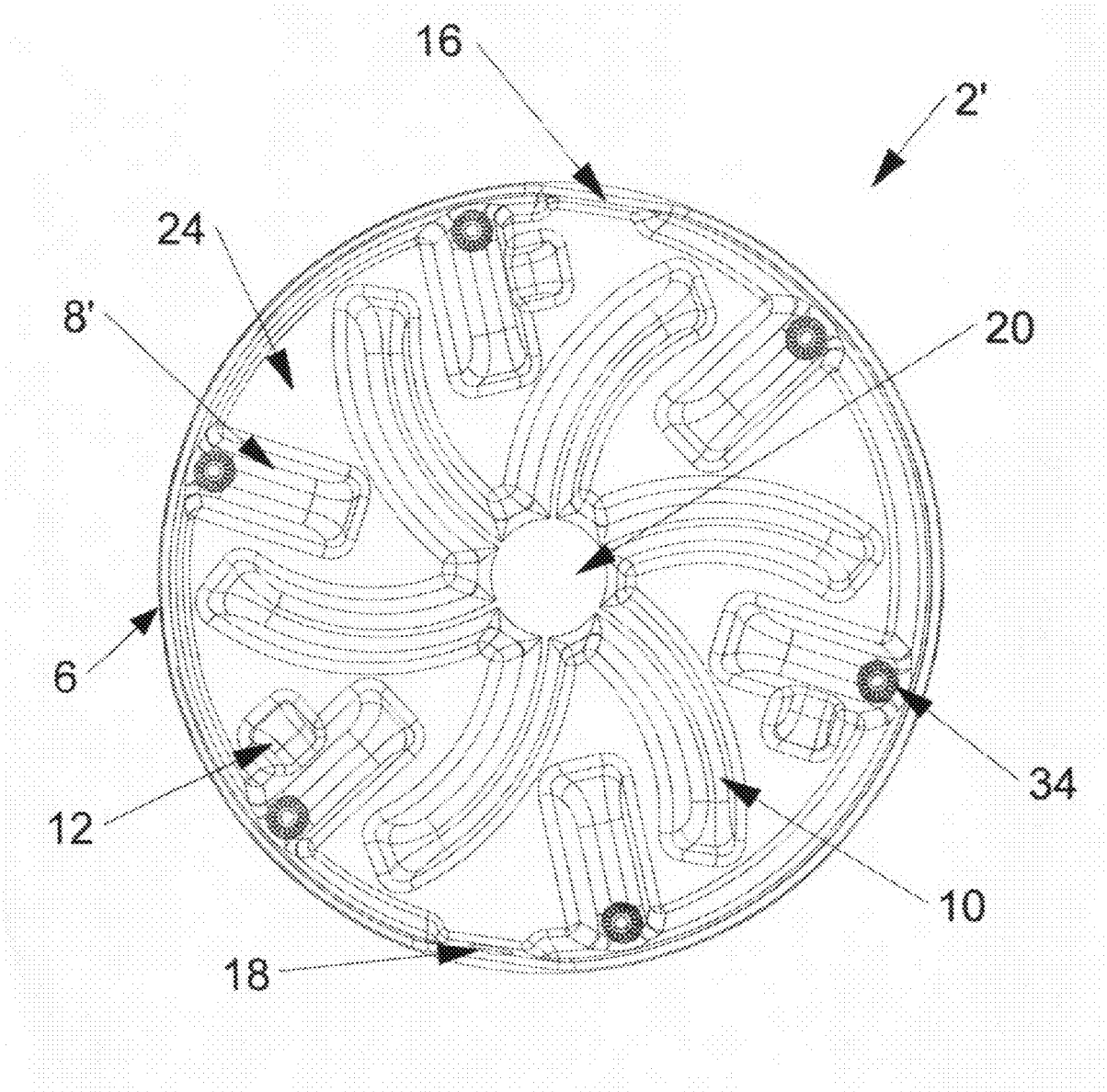
FIG. 9 is a top view of the second preferred embodiment of the present invention Previously shown in FIG. 5, with six vibration isolators (as shown in FIG. 8) each associated with a different one of the risers 8' present.

The last three illustrations accompanying this invention disclosure are FIG. 7, which shows an upright storage hot water heater tank 32 supported upon a present invention pan 2, FIG. 8 which shows one configuration of vibration isolator 34 that can be used as a part of the present invention pan (2, 2' or other) in indentations 14, and FIG. 9 which shows six of the vibration isolators shown in FIG. 8 associated with the risers 8' in the second preferred embodiment 2' of the present invention. The vibration isolator (34 or other) used with indentations 14 should have a large upper portion, relative to the stem underneath it, with the stem being the part thereof inserted into an indentation 14, and the underside surface of the large upper portion providing a large area of contact with the top surface of risers 8 that help to resist roll-over and/or separation of vibration isolator (34 or other) from its associated indentation 14 as a heavy hot water heater tank 32 is moved over central hub 20, spokes 10, and risers 8 for installation into its preferred position of use. Also, the vibration isolator (34 or other) used with indentations 14 should have additional means associated with its stem that are adapted to help it to resist popping out of its associated indentation 14 as hot water heater tank 32 is moved across central hub 20, spokes 10, and risers 8, to help make the installation of the pan (2, 2' or other) and hot water heater tank 32 faster and easier, with less risk of damage to the present invention pan that could lead to the development of cracks later on during use.

An example of a workable height dimension for present invention pan (2, 2' or other), although not limited thereto, is approximately three inches, which would be sufficient to protect a hot water heater tank 32 and its surrounding from slow leaks associated with tank 32 operation and maintenance, but not provide a water-holding capacity to accommodate the entire water volume present in tank 32 at once, should catastrophic failure thereof occur. Hereinafter in this paragraph, in an attempt to avoid repetitive language and improve clarity of description, a reference will only be made to pan 2, while it is to be understood that the mention of pan 2 is also intended to refer to pan 2' and other embodiments considered to be within the scope of the claims appended hereto. Also, present invention pan 2 could have an approximate diameter dimension of twenty-four inches and a minimum inside diameter dimension for up-turned lip 6 of approximately twenty-six inches. In addition to the benefit provided by its water-holding capability, the present invention pan (2, 2', or other) has elevated structure that raises the exterior bottom surface of a hot water heater tank 32 above any collected water to decrease the risk of premature deterioration as a result of corrosion, which would otherwise occur if a hot water heater tank 32 was allowed to sit in water for any length of time should an undiscovered slow leak have occurred. Its multi-level integrated structure also strengthens pan (2, 2', or other), providing a material cost advantage by allowing less material to be used to achieve the same strength as a pan without equivalent structure. Mold deterrence is another benefit from elevated positioning of a hot water heater tank 32 supported by a present invention pan 2. As the convex top surface of each spoke 10 and riser 8 deflects water away from a supported hot water heater tank 32, and the air circulation space provided by vibration isolators 34 between the exterior bottom surface of tank 32 and central hub 20, spokes 10, and risers 8 allowing movement of fluid away from tank 32 as a result of gravity and evaporation, thereby reducing the incidence of corrosion and mold on tank 32 and helping to reduce maintenance issues for it and prolong its useful life. The use of vibration isolators 34 also increases ease of handling for installers, as they allow a heavy hot water heater tank 32 to be set on the edge of pan 2 and for it to slide across central hub 20, spokes 10, and risers (8, 8', or other) without damage to the structural integrity of pan 2. Although the material used for pan 2 can vary, all present invention pans (2, 2', or other) comprise sturdy and impact-resistant materials that are crack-resistant, corrosion resistant, extremely durable (more than twice as strong as standard ABS plastic), fire-resistant, and resistant to extreme temperatures without deforming from their original configuration or becoming brittle. Resistance to UV radiation is not necessarily a contemplated feature of the present invention, unless dictated by the application. In addition, a liquid-level float switch (not shown) can be mounted on perimeter wall 4 for sounding an alarm or forwarding a message to a remote location when fluid collected in pan 2 exceeds a pre-determined threshold amount considered safe. Furthermore, although not shown, it is contemplated for the most preferred embodiments of pan 2 to be formed from one sheet of plastic material and provide unitary construction. However, manufacture of the present invention could be accomplished by blow molding, injection molding, assembly of pre-formed individual components, or a combination thereof, with the choice of manufacturing being determined by the anticipated purchase cost to consumers and the expected duration of use without maintenance, parts replacement, or repair. The sturdy materials used for present invention pan 2 construction, the arcuate structure of the spokes 10, and the placement of the risers (8, 8', 12 or other) are all designed to reduce pressure points, cracks, and other sources of material deterioration that have often resulted during the handling and installation of prior art pans, and which after occurrence can worsen over time and prevent prior art pans from effectively fulfilling their intended functions. Thus, minimal maintenance for all present invention pans (2, 2', and other) is also contemplated. Also, although the present invention is primarily contemplated for use in hot water heater tank 32 applications, it also may be used in other applications where rising fluid beyond a threshold limit is undesirable and automated shut-off of the fluid source is needed to eliminate the risk of equipment and/or property damage. The upturned lip 6 and perimeter wall 4 of the present invention pan do not provide support for any portion of an upright hot water heater tank 32, the weight of which is instead supported by risers (8, 8', or other). Another benefit of the present invention is that use of a present invention pan (2, 2', or other) also assists an installer in meeting the space requirements established by local code between the side of hot water heater tank 32 and adjacent structures.

What is claimed is:

1. A sturdy multi-level pan for use in stable support of a heavy cylindrical fluid-storage tank positioned in an upright orientation, collecting fluid related to tank operation and maintenance including that attributable to slow leaks, and supporting the tank in a position above the maximum allowable pan depth for collected fluid, said pan comprising:

a non-raised bottom surface;

a circular perimeter wall upwardly depending from said bottom surface;

a raised central hub associated with said bottom surface;

a plurality of spaced-apart spokes extending outwardly in differing directions from said raised central hub, said spokes each having an arcuate perimeter configuration; and a plurality of risers also associated with said non-raised bottom surface and extending from said perimeter wall toward said raised central hub.

2. The pan of claim 1 wherein each said riser further comprises at least one top indentation configured for securely receiving a vibration isolator, and said pan further comprises a plurality of vibration isolators each configured for association with one of said risers, wherein when a tank is supported above said pan, said vibration isolators will provide contact with a supported tank and sufficient air circulation space between the tank and said hub, spokes, and risers to allow movement of fluid away from the tank as a result of gravity and evaporation, so that the incidence of corrosion and mold on the tank is reduced, helping to reduce maintenance issues for the tank and prolong its useful life.

3. The pan of claim 1 further comprising a non-arcuate low elevation riser laterally depending from at least one of said risers in perpendicular orientation thereto, with said low elevation riser having a lower height dimension than that of said riser from which it depends.

4. The pan of claim 3 further comprising an upturned lip upwardly extending from said perimeter wall.

5. The pan of claim 4 wherein said perimeter wall and said upturned lip are both in upwardly and outwardly extending orientations relative to said bottom surface.

6. The pan of claim 5 wherein said upturned lip has a height dimension that raises it to a higher elevation than said central hub, said spokes, and said risers.

7. The pan of claim 1 further comprising an upturned lip upwardly extending from said perimeter wall.

8. The pan of claim 7 wherein said perimeter wall and said upturned lip are both in upwardly and outwardly extending orientations relative to said bottom surface.

9. The pan of claim 7 further comprising a drain opening through said perimeter wall and wherein said drain opening is positioned to extend across a portion of said upturned lip.

10. The pan of claim 1 further comprising a drain opening through said perimeter wall.

11. The pan, of claim 10 further comprising a flattened area in said perimeter wall opposed from said drain opening, said flattened area being configured to facilitate nesting of multiple ones of said pans in stacked array.

12. The pan of claim 1 wherein said hub has a diameter dimension and at least one of said spokes has a length dimension larger than said diameter dimension, wherein said risers each have a distal end and at least one of said risers has an indentation in said distal end, and wherein at least one of said risers has an arcuate perimeter configuration.

13. The pan of claim 1 wherein said hub has a diameter dimension and at least one of said spokes has a length dimension approximately twice as large as said diameter dimension, wherein said risers each have a proximal end and at least one of said risers has an indentation in said proximal end, and wherein at least one of said risers has a non-arcuate perimeter configuration.

14. The pan of claim 1 wherein said central hub, said spokes, said risers, and said perimeter wall further comprise a nesting configuration that provides compact storage and transport when two or more of said pans are placed next to one another in a stacked array.

15. The pan of claim 14 further comprising small indents mismatched in configuration to one another that are configured and positioned to keep adjacent ones of said pans in stacked array from becoming stuck together.

16. The pan of claim 1 wherein said central hub, said spokes and said risers are each configured to deflect water downwardly into said non-raised bottom collecting surface and away from a supported fluid-holding tank.

17. The pan of claim 1 wherein said central hub, said spokes and said risers each have a downwardly and outwardly sloping perimeter surface.

18. The pan of claim 1 wherein said spokes and said risers each have a convex top surface configured to diminish fluid accumulation thereon.

19. The pan of claim 3 wherein said central hub, said spokes, said risers, and said low elevation risers are each configured and positioned to collectively reduce stress cracks in said pan during its manufacture, installation and use.

20. A sturdy multi-level pan for use in stable support of a heavy cylindrical fluid-storage tank positioned in an upright orientation, collecting fluid related to tank operation and maintenance including that attributable to slow leaks, and supporting the tank in a position above the maximum allowable depth for collected fluid, said pan comprising:

a non-raised bottom surface having a circular perimeter configuration;

a perimeter wall upwardly depending from said circular perimeter configuration of said bottom surface;

a raised hub centrally integral with said non-raised bottom surface;

a plurality of spaced-apart spokes also integral with said non-raised bottom surface and extending outwardly in differing directions from said raised central hub, said spokes each having an arcuate perimeter configuration and a substantially even height dimension to that of said hub;

a plurality of risers also integral with said non-raised bottom surface and extending from said perimeter wall toward said raised central hub, with adjacent ones of said spokes having at least one riser positioned therebetween, each said riser also having a substantially even height dimension to that of said hub and spokes, and each said riser having at least one top indentation configured for securely receiving a vibration isolator; and at least one vibration isolator associated with each said riser, said vibration isolators configured for contact with the bottom surface of a fluid-storage tank and also configured to have sufficient height dimension to maintain the tank at a spaced-apart distance above said central hub, said spokes, and said risers, wherein when a tank is supported above said pan, said vibration isolators provide sufficient air circulation space between the bottom surface of the tank and said hub, spokes, and risers to allow movement of fluid away from the tank as a result of gravity and evaporation, so that the incidence of corrosion and mold on the tank is reduced, helping to reduce maintenance issues for the tank and prolong its useful life.

* * * * *